US009994404B2

(12) United States Patent
Ngoc

(10) Patent No.: US 9,994,404 B2
(45) Date of Patent: Jun. 12, 2018

(54) ROLLER SUPPORT MECHANISM, SHEET CONVEYING DEVICE INCLUDING ROLLER SUPPORT MECHANISM, IMAGE FORMING APPARATUS

(71) Applicant: KYOCERA Document Solutions Inc., Osaka-shi, Osaka (JP)

(72) Inventor: Khong Huu Ngoc, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days. days.

(21) Appl. No.: 15/645,670

(22) Filed: Jul. 10, 2017

(65) Prior Publication Data

US 2018/0016107 A1 Jan. 18, 2018

(30) Foreign Application Priority Data

Jul. 14, 2016 (JP) ..... 2016-139742

(51) Int. Cl.
*B65H 5/06* (2006.01)
*B65H 29/20* (2006.01)

(52) U.S. Cl.
CPC ..... *B65H 5/06* (2013.01); *B65H 29/20* (2013.01); *B65H 2402/32* (2013.01); *B65H 2402/52* (2013.01); *B65H 2402/521* (2013.01); *B65H 2402/522* (2013.01); *B65H 2404/19* (2013.01); *B65H 2801/06* (2013.01)

(58) Field of Classification Search
CPC ..... B65H 2402/52; B65H 2402/521; B65H 2402/5211; B65H 2402/522; B65H 2402/5221; B65H 2402/52211; B65H 2402/531; B65H 2404/17; F16C 35/042; F16C 35/045; F16C 35/067
See application file for complete search history.

(56) References Cited

U.S. PATENT DOCUMENTS 6,059,286 A * 5/2000 Miyashita ..... B65H 5/062 271/273
6,511,227 B1 * 1/2003 Siow ..... B65H 27/00 384/296

(Continued)

FOREIGN PATENT DOCUMENTS

JP 2004252378 A 9/2004

*Primary Examiner* — Jeremy R Severson
(74) *Attorney, Agent, or Firm* — Alleman Hall Creasman & Tuttle LLP

(57) ABSTRACT

A roller support mechanism includes a pair of support plates, concave groove portions, and sliding bearing portions. The support plates are formed from an elastic material and disposed to face each other. The concave groove portions are formed in the support plates and each include an opening portion, two arc rims, and a straight line rim. The arc rims extend in a groove depth direction of the concave groove portion from opposite ends of the opening portion. The straight line rim extends straightly and connects extention ends of the arc rims. The sliding bearing portions have bearing holes in which a rotation shaft of a roller member is inserted. In a state where the rotation shaft is inserted in the bearing holes, the sliding bearing portions are pressed into the concave groove portions so as to be in close contact with their inner circumferential surfaces and unrotatably attached to them.

7 Claims, 7 Drawing Sheets

(56) References Cited

U.S. PATENT DOCUMENTS

| | | | | |
|---|---|---|---|---|
| 8,896,644 | B2 * | 11/2014 | Sunouchi | B41J 13/076 271/274 |
| 9,395,671 | B1 * | 7/2016 | Yano | G03G 15/6529 |
| 2004/0075728 | A1 * | 4/2004 | Ha | B41J 13/02 347/104 |
| 2006/0107861 | A1 * | 5/2006 | Ho | B65H 27/00 101/486 |
| 2016/0289024 | A1 * | 10/2016 | Morizono | B65H 5/062 |

* cited by examiner

ROLLER SUPPORT MECHANISM, SHEET CONVEYING DEVICE INCLUDING ROLLER SUPPORT MECHANISM, IMAGE FORMING APPARATUS

INCORPORATION BY REFERENCE

This application is based upon and claims the benefit of priority from the corresponding Japanese Patent Application No. 2016-139742 filed on Jul. 14, 2016, the entire contents of which are incorporated herein by reference.

BACKGROUND

The present disclosure relates to a roller support mechanism including a bearing that support a rotation shaft of a conveyance roller, a sheet conveying device including a roller support mechanism, and an image forming apparatus.

A conventional image forming apparatus, such as a copier or a printer, includes a sheet conveying device that conveys a sheet member (print sheet). The sheet conveying device includes a conveyance roller for conveying the sheet member. Upon transmission of a rotational driving force from a motor or the like, the conveyance roller conveys the sheet member along a conveyance path provided inside the apparatus. There is known, as one example of this type of sheet conveying device, a support mechanism in which a support frame fixed to a housing supports a rotation shaft of the conveyance roller via a bearing. For example, there is known a support mechanism in which sliding bearings are used as a bearing structure for a roller used in a developing device.

SUMMARY

A roller support mechanism according to an aspect of the present disclosure includes a pair of support plates, two concave groove portions, and two sliding bearing portions. The pair of support plates are formed from an elastic material and disposed to face each other. The two concave groove portions are respectively formed in the pair of support plates. Each of the two concave groove portions includes an opening portion, two arc rims, and a straight line rim. The two arc rims extend in a groove depth direction of the concave groove portion from opposite ends of the opening portion. The straight line rim extends straightly and connects extention ends of the two arc rims. The two sliding bearing portions respectively have bearing holes in which a rotation shaft of a roller member is inserted. In a state where the rotation shaft is inserted in the bearing holes, the sliding bearing portions are pressed into the concave groove portions so that the sliding bearing portions are in close contact with inner circumferential surfaces of the concave groove portions and are unrotatably attached to the concave groove portions.

A sheet conveying device according to another aspect of the present disclosure includes the roller support mechanism and a conveyance roller whose rotation shaft is rotatably supported by the roller support mechanism, wherein the conveyance roller is configured to convey a sheet member.

An image forming apparatus according to a further aspect of the present disclosure includes the sheet conveying device and an image forming portion that is configured to form an image on the sheet member conveyed by the sheet conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 7A is a side diagram showing the side plate viewed from outside in an axial direction; and FIG. 7B is a cross-sectional diagram taken along a cut surface passing through a projection provided on the side plate.

DETAILED DESCRIPTION

Figure 1:
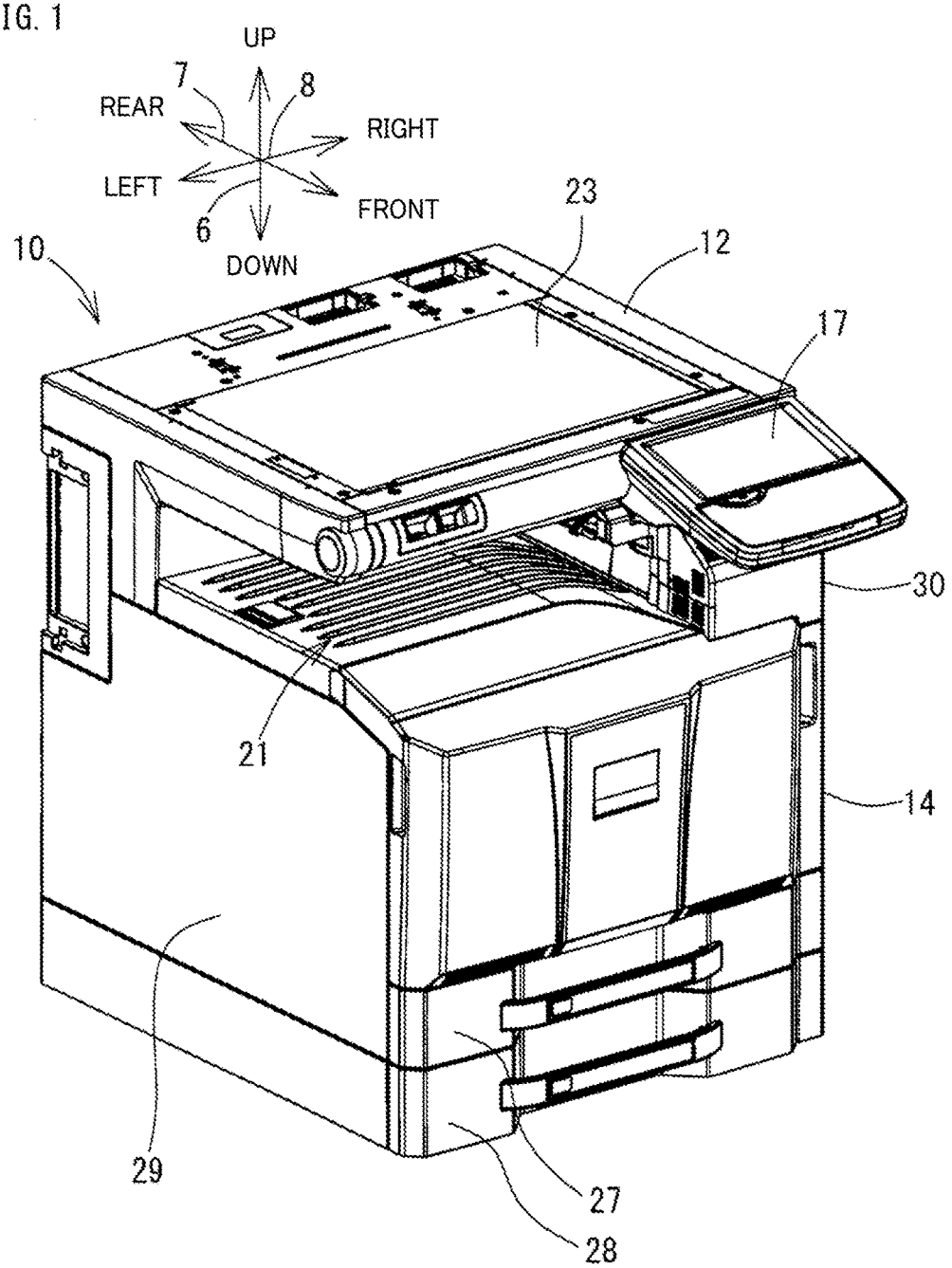
FIG. 1 is a perspective diagram showing a configuration of an image forming apparatus according to an embodiment of the present disclosure.

The following describes an image forming apparatus 10 and a sheet conveying portion 60 (an example of the sheet conveying device of the present disclosure) that is provided in the image forming apparatus 10, with reference to the accompanying drawings. It is noted that for the sake of explanation convenience, an up-down direction 6 is defined as a vertical direction in a state where the image forming apparatus 10 is installed on a horizontal surface (the state shown in FIG. 1). In addition, a front-rear direction 7 is defined on a basis that a side on which an operation/display panel 17 is provided is a front side. Furthermore, a left-right direction 8 is defined based on the front side of the image forming apparatus 10. It should be noted that the following embodiment is an example of a specific embodiment of the present disclosure and should not limit the technical scope of the present disclosure.

First, a configuration of the image forming apparatus 10 is described with reference to FIG. 1 to FIG. 3.

Figure 2:
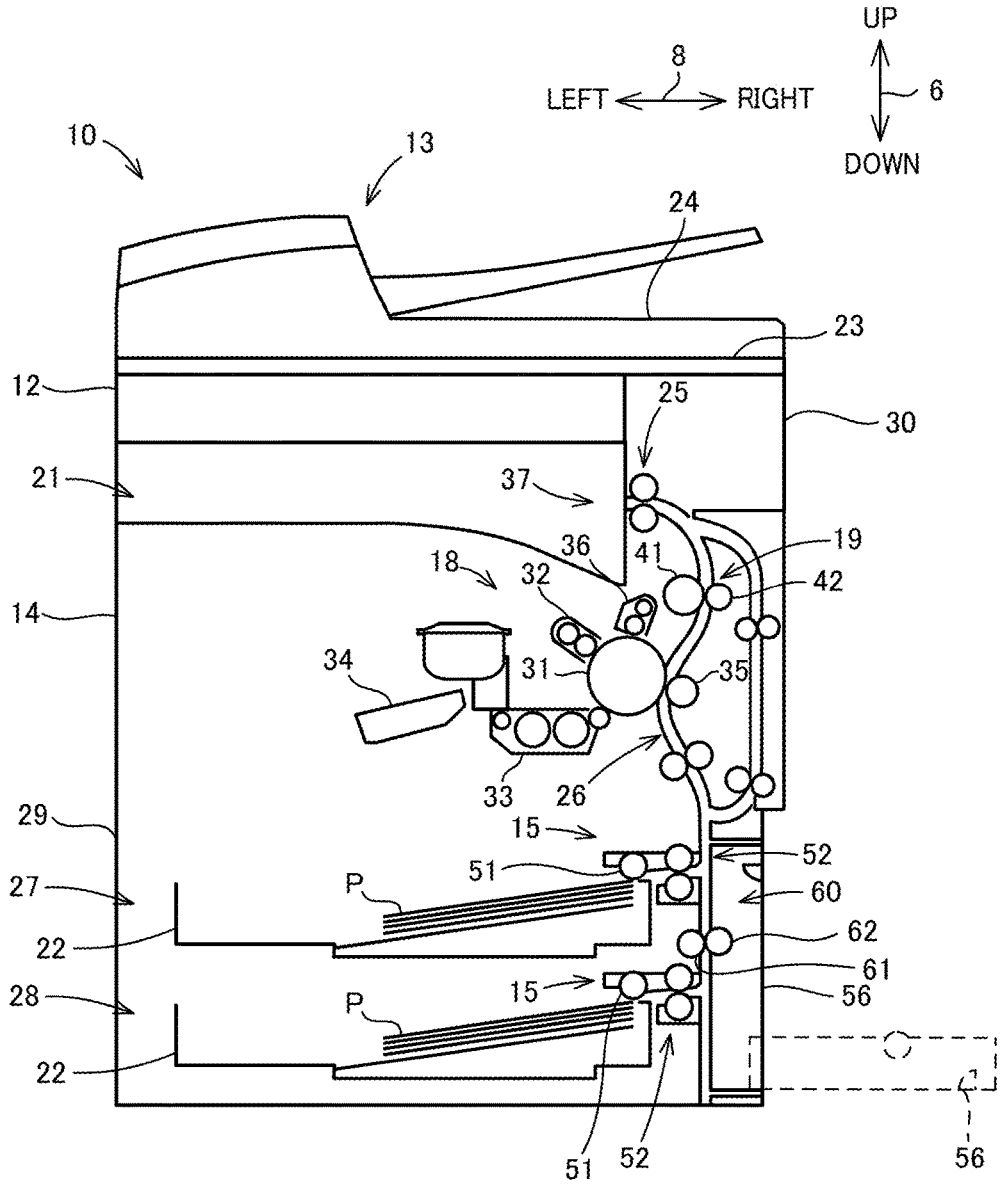
FIG. 2 is a diagram showing an internal configuration of the image forming apparatus shown in FIG. 1.

As shown in FIG. 1, the image forming apparatus 10 is a multifunction peripheral having a plurality of functions such as the functions of a printer, a copier, a facsimile apparatus, and a scanner. The image forming apparatus 10 forms an image of an input image on a print sheet P (an example of the sheet member of the present disclosure) by using a print material such as toner. It is noted that the image forming apparatus 10 is not limited to a multifunction peripheral, but may be a dedicated apparatus such as a printer, a copier, or a facsimile apparatus.

The image forming apparatus 10 includes an image reading portion 12 and an image forming portion 14. The image reading portion 12 performs a process of reading an image from a document sheet, and is provided in the upper portion of the image forming apparatus 10. The image forming portion 14 includes two sheet feed devices 27 and 28 that are arranged as two tiers in the vertical direction. The sheet feed device 27, the upper one of the two sheet feed devices, is integrally formed with a housing 29 in the lowest portion of the image forming portion 14. The sheet feed device 28, the lower one of the two sheet feed devices, is extension-type and is attached to the bottom surface of the housing 29 of the image forming portion 14 as an option device. The sheet feed device 28 is configured to be attachable to and dechable from the bottom surface of the housing 29. In addition, a sheet discharge portion 30 for discharging the print sheet P after image formation to outside is provided on the right side of the image forming portion 14. It is noted that the image forming portion 14 is not limited to the electrophotographic image forming portion, but may be an image forming portion adapted to an inkjet recording method or other recording or printing methods.

The image reading portion 12 reads image data from a document sheet set on a document sheet placement table 23. In addition, as shown in FIG. 2, the image reading portion 12 includes an ADF (automatic document feeder) 13. The ADF 13 is provided in a document sheet cover 24. The ADF 13 conveys the document sheet to a reading position where an image of a document sheet passing the reading position is read by the image reading portion 12. It is noted that in FIG. 1, the document sheet cover 24 of the image reading portion 12 is omitted.

The image forming portion 14 forms an image on a print sheet P of a standard size such as an A series size or a B series size, based on image data read by the image reading portion 12 or based on image data input from an external source. As shown in FIG. 2, the image forming portion 14 includes the sheet feed devices 27 and 28, an electrophotographic image transfer portion 18, a fixing portion 19, and the sheet conveying portion 60. A print sheet P with an image formed thereon is discharged to a discharge space 21.

The sheet feed devices 27 and 28 feed a print sheet P to a vertical conveyance path 26. Each of the sheet feed devices 27 and 28 includes a sheet storage portion 22 having the shape of a tray, and a feeding mechanism 15. In the sheet storage portion 22, print sheets P (print sheets P used for image formation) on which images are formed by the image transfer portion 18 are stacked. The feeding mechanism 15 picks up, one by one, the print sheets P stored in the sheet storage portion 22, and feeds the print sheet P. The feeding mechanism 15 is provided above the right end part of the sheet storage portion 22. The feeding mechanism 15 includes a pick-up roller 51 and a pair of feeding rollers 52.

On the right side of the housing 29, a cover 56 is provided, wherein the cover 56 constitutes a part of an external panel of the image forming apparatus 10. The cover 56 is provided on the right side of the sheet feed devices 27 and 28. The cover 56 is pivotably supported by the housing 29. In the present embodiment, the cover 56 is provided on the right side of the housing 29, and is supported so as to be opened to be in an opening position (the position represented by a dotted line in FIG. 2) for exposing a part of the vertical conveyance path 26 and closed to be in a closing position (the position indicated in FIG. 2) for forming the vertical conveyance path 26 by closing the right side of the housing 29.

The sheet conveying portion 60 is provided on the right side of the image forming portion 14. More specifically, the sheet conveying portion 60 is provided on the right side of a housing 28A of the sheet feed device 28 (see FIG. 3). The sheet conveying portion 60 conveys the print sheet P fed from the sheet feed device 28, upward along the vertical conveyance path 26. The sheet conveying portion 60 is composed of a conveyance roller 61 (an example of the roller member of the present disclosure), the cover 56, and a rotation roller 62 provided in the cover 56.

Figure 3:
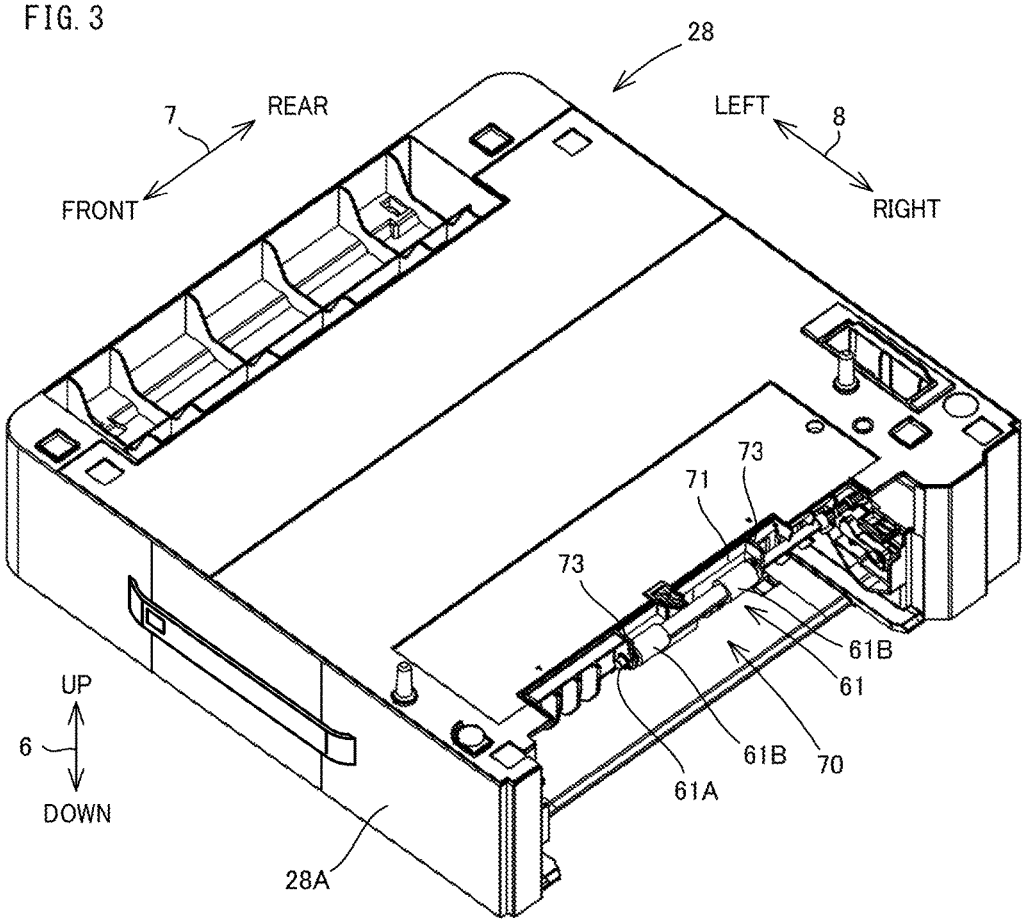
FIG. 3 is a perspective diagram of a sheet feed device of the image forming apparatus.

As shown in FIG. 3, a roller support mechanism 70 is provided inside the housing 28A of the sheet feed device 28, wherein the roller support mechanism 70 is configured to support the conveyance roller 61. The conveyance roller 61 is rotatably supported by the roller support mechanism 70. The conveyance roller 61 is a driving roller to which a rotational driving force from a motor is transmitted, and two rotors 61B are held on a rotation shaft 61A. The conveyance roller 61 is provided at a position that faces an inner surface of the cover 56 when the cover 56 has the closing position. The inner surface of the cover 56 is a guide surface of the vertical conveyance path 26, and the rotation roller 62 is provided on the inner surface. When the cover 56 has the closing position, the conveyance roller 61 is pressure-contacted with the rotation roller 62. The conveyance roller 61 and the rotation roller 62 constitute a pair of conveyance rollers. When the conveyance roller 61 rotates, the rotation roller 62 rotates following the rotation of the conveyance roller 61. With this configuration, the print sheet P is conveyed toward the image transfer portion 18 by the conveyance roller 61 and the rotation roller 62. It is noted that the roller support mechanism 70 is described below.

The image transfer portion 18 is disposed above the paper sheet feed device 27. The image transfer portion 18 includes a photoconductor drum 31, a charging portion 32, a developing portion 33, a laser scanning device 34, a transfer roller 35, and a cleaning portion 36.

The fixing portion 19 fixes the toner image transferred on the print sheet P to the print sheet P by heat. The fixing portion 19 includes a heating roller 41 and a pressure roller 42. The toner is fixed to the print sheet P by the fixing portion 19.

At the end of the vertical conveyance path 26, a paper sheet discharge outlet 37, through which the print sheet P is discharged, is provided. In the vicinity of the paper sheet discharge outlet 37, a pair of discharge rollers 25 are provided. The print sheet P is conveyed from the paper sheet discharge outlet 37 toward the sheet discharge space 21 by the pair of discharge rollers 25.

Meanwhile, in the case of a conventional support mechanism that uses sliding bearings, the sliding bearings are fitted into frames or the like for the fixation thereof. As a result, the fit tolerance needs to be taken into account, and a high processing accuracy is required for the parts thereof. This not only increases the cost of the parts, but also makes the attachment work of the sliding bearings complicated. The roller support mechanism 70 of the present embodiment enables sliding bearing portions 90 described below to be attached easily in a reliable manner and with a low cost.

The following describes a configuration of the roller support mechanism 70 with reference to FIG. 3 to FIG. 9. It is noted that FIG. 3 shows a state where the cover 56 is removed.

Figure 4:
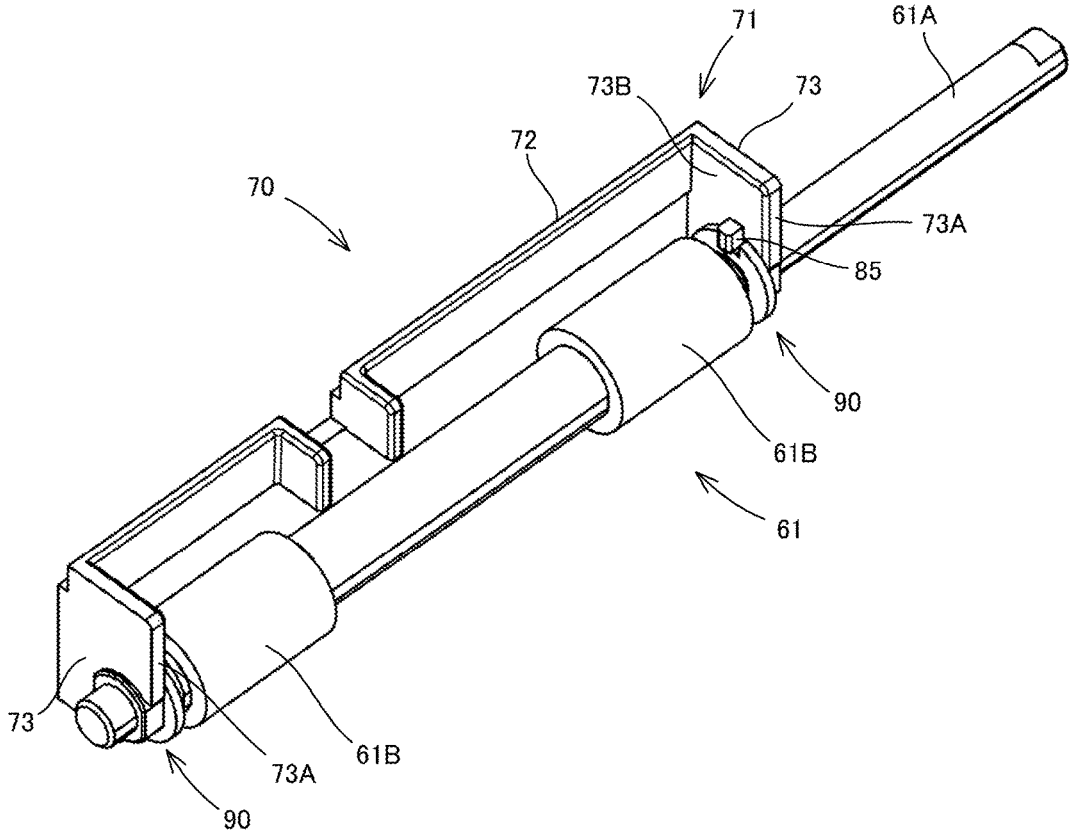
FIG. 4 is a perspective diagram showing a configuration of a roller support mechanism.

As shown in FIG. 3, the roller support mechanism 70 is provided on the right side of the housing 28A of the sheet feed device 28 (see FIG. 3). The roller support mechanism 70 includes a support frame 71. The support frame 71 is fixed to an inner frame of the housing 28A. As shown in FIG. 4, the support frame 71 is formed plate-like from a synthetic resin, in an elongated shape extending in the front-rear direction 7 on the right side of the housing 28A. Accordingly, the support frame 71 is flexible. That is, the support frame 71 is bent upon receiving a force. The support frame 71 includes a base plate 72 and two side plates 73 (an example of the pair of support plates).

As shown in FIG. 4, the two side plates 73 project vertically from opposite ends of the base plate 72 that oppose in the longitudinal direction of the base plate 72. The two side plates 73 are disposed to face each other in the front-rear direction 7. The rotation shaft 61A of the conveyance roller 61 is rotatably supported by the side plates 73 via the sliding bearing portions 90 that are described below.

Figure 5:
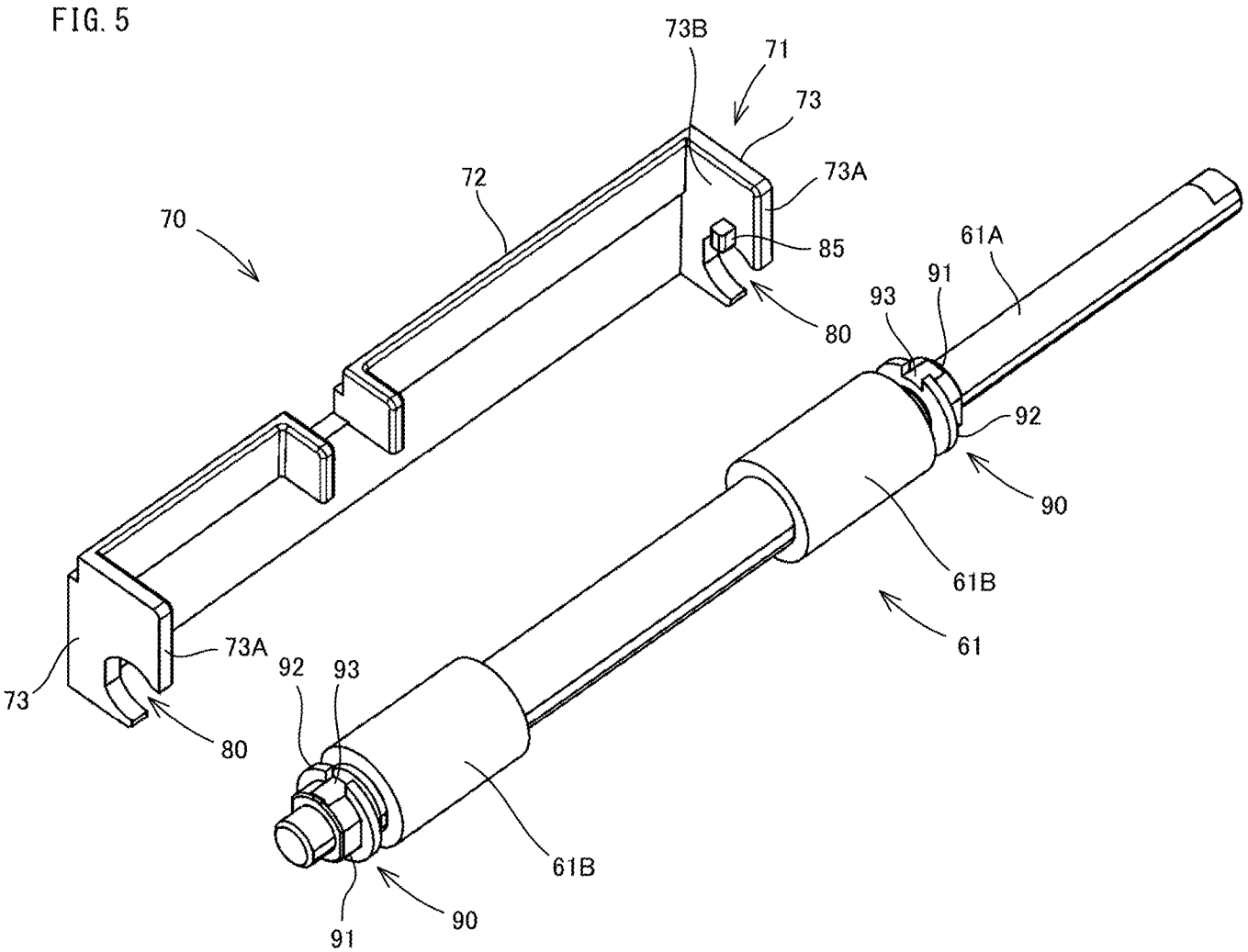
FIG. 5 is an exploded perspective diagram showing a configuration of the roller support mechanism.

As shown in FIG. 5, two concave groove portions 80 are respectively formed in the side plates 73. In addition, two sliding bearing portions 90 are attached to the rotation shaft 61A.

Figure 6A:
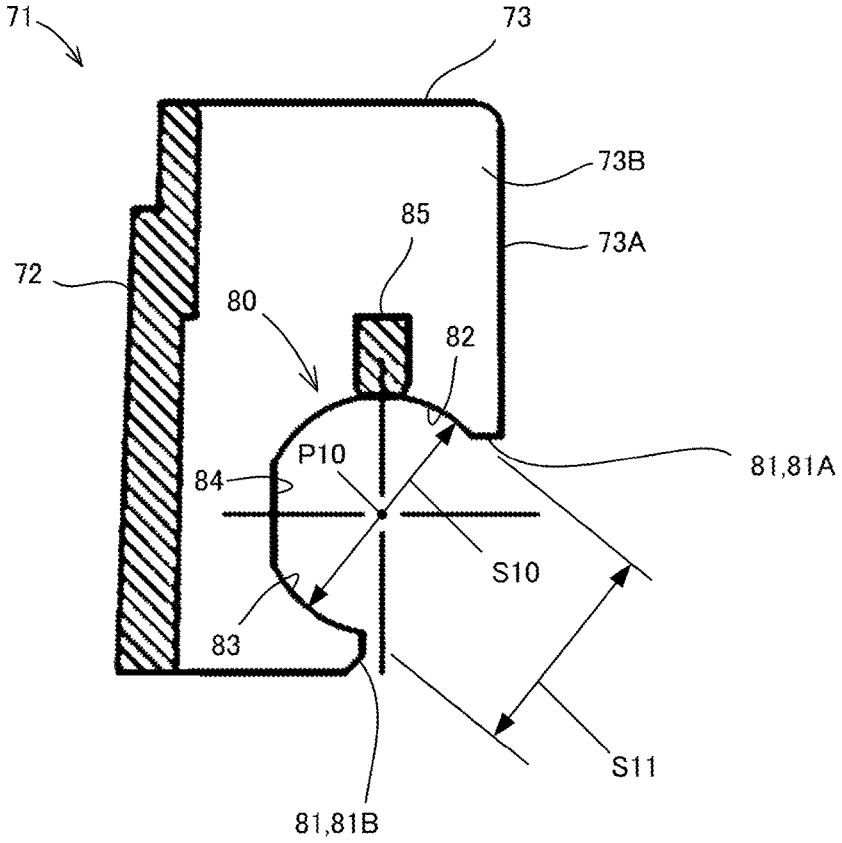
FIG. 6A is an enlarged diagram showing a side plate.

FIG. 6A is an enlarged diagram showing one of the side plates 73. As shown in FIG. 6A, the concave groove portion 80 is a cut groove formed in each of the side plates 73. The concave groove portion 80 is formed in a so-called D-CUT shape. Specifically, the concave groove portion 80 includes an opening portion 81 formed at a protruding end 73A of the side plate 73. The opening portion 81 is an opening in which a shaft portion 91 of the sliding bearing portion 90 is inserted, as described below. In addition, the concave groove portion 80 includes two arc rims 82 and 83 and a straight line rim 84. The arc rim 82 extends from an end 81A of the opening portion 81, and the arc rim 83 extends from an end 81B of the opening portion 81, both extending in a groove depth direction of the concave groove portion 80. The arc rims 82 and 83 are formed in arcs that have the same curvature. The arc rim 82 above is longer than the arc rim 83 below, and approximately twice as long as the arc rim 83 below. The straight line rim 84 connects the extention ends of the arc rims 82 and 83, and extends in the up-down direction 6 in FIG. 6A.

In the present embodiment, the arc rims 82 and 83 constitute parts of an arc of an imaginary circle centered at a center point P10 of the concave groove portion 80. A maximum diameter S10 of the concave groove portion 80 is 9.0 mm, the maximum diameter S10 passing through the center point P10. In addition, a size S11 of the opening portion 81 is 8.09 mm.

As shown in FIG. 4 and FIG. 5, the two sliding bearing portions 90 are attached to the rotation shaft 61A so as to be separate from each other in the axial direction of the rotation shaft 61A. The sliding bearing portions 90 are formed from a synthetic resin. Each of the sliding bearing portions 90 has a bearing hole 96 (see FIG. 6B) in which the rotation shaft 61A is inserted. The rotation shaft 61A is rotatably inserted in the bearing holes 96. In a state where the rotation shaft 61A is inserted in the bearing holes 96, the two sliding bearing portions 90 are respectively pressed into the concave groove portions 80 so that the sliding bearing portions 90 are in close contact with the inner circumferential surfaces of the concave groove portions 80 and unrotatably attached to the concave groove portions 80.

Figure 6B:
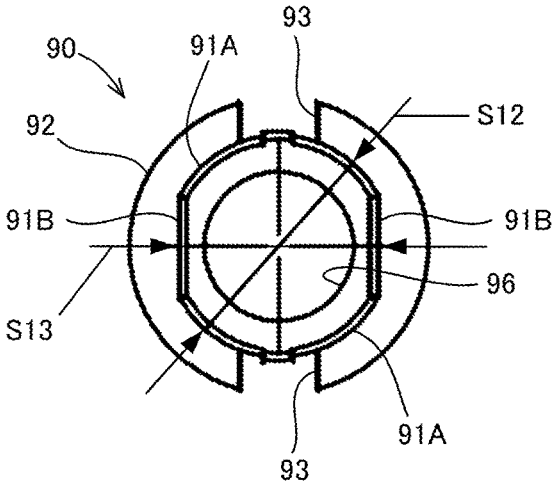
FIG. 6B is an enlarged diagram showing a sliding bearing portion.
Figure 7A:
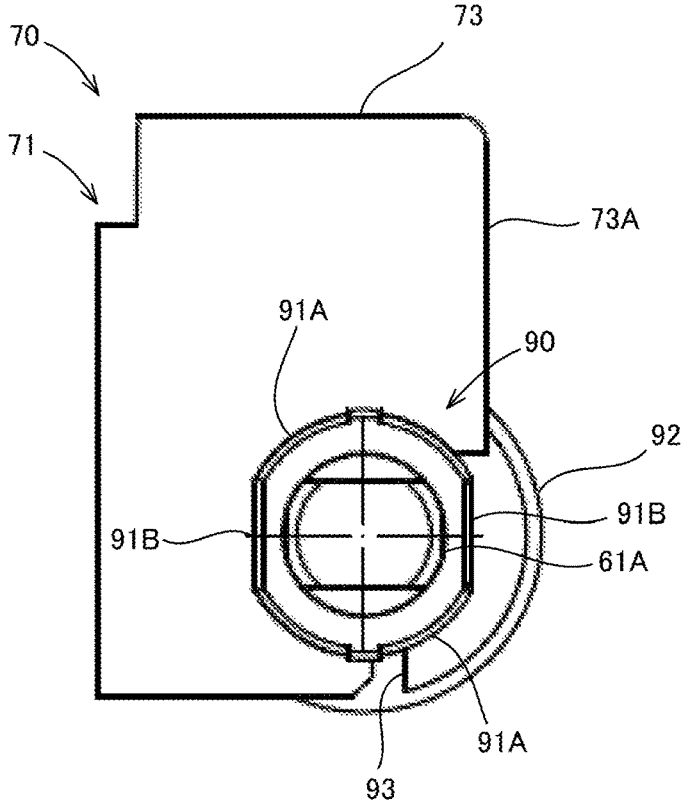
FIG. 7A and FIG. 7B are diagrams showing a state where a rotation shaft of a conveyance roller is supported by a roller support mechanism.
Figure 7B:
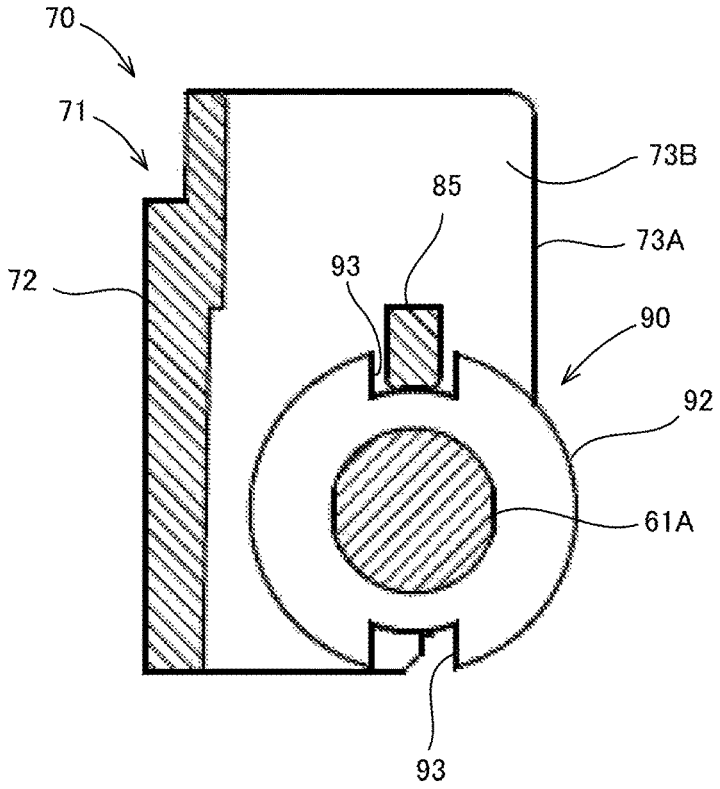

Each of the sliding bearing portions 90 includes a cylindrical shaft portion 91 and a disc-shaped flange 92. The shaft portions 91 are respectively attached to the concave groove portions 80. Each of the flanges 92 projects radially outward from one of opposite ends of a corresponding shaft portion 91, the opposite ends opposing in the axial direction of the shaft portion 91. The outer circumferential surface of the shaft portion 91 is formed in a shape that corresponds to the inner circumferential surface of the concave groove portion 80. As shown in FIG. 6B, the outer circumferential surface of the shaft portion 91 is formed in a so-called double D-CUT shape. Here, FIG. 6B is an enlarged diagram showing the sliding bearing portion 90. Specifically, the outer circumferential surface of the shaft portion 91 has arc surfaces 91A and flat surfaces 91B, wherein the arc surfaces 91A are disposed to face each other and have the same curvature, and the flat surfaces 91B are disposed to face each other. In the present embodiment, a maximum outer diameter size S12 (the outer diameter of the arc surfaces 91A) of the shaft portion 91 is 8.97 mm. On the other hand, a minimum outer diameter size S13 (the outer diameter of the flat surfaces 91B) of the shaft portion 91 is set to be smaller than the size of the opening portion 81.

The flange 92 comes into surface contact with an inner side surface 73B of the side plate 73 in a state where the sliding bearing portion 90 is attached to the concave groove portion 80. As shown in FIG. 6B, rectangular cuts 93 are formed in the flange 92. Two cuts 93 are formed in the flange 92. The cuts 93 are formed on the outer circumferential portion of the flange 92 so as to be separate from each other by 180 degrees in the circumferential direction.

In addition, a projection 85 is formed on the inner side surface 73B of each side plate 73. The projection 85 is formed in a rectangular shape and sized so as to be inserted in the cut 93. When the sliding bearing portion 90 is attached to the concave groove portion 80, the projection 85 is inserted in the cut 93.

With the above-described configuration of the roller support mechanism 70, the worker can attach the rotation shaft 61A to the roller support mechanism 70 as follows. That is, the worker inserts the shaft portions 91 into the opening portions 81 of the concave groove portions 80 in a state where the sliding bearing portions 90 have been attached to the rotation shaft 61A. At this time, the worker rotates the two sliding bearing portions 90 until the cuts 93 are located at the upper end. In this state, a part of the shaft portion 91 where the shaft portion 91 has the maximum diameter, is disposed to face the opening portion 81. As described above, the size S11 of the opening portion 81 is 8.09 mm, while the maximum outer diameter size S12 of the shaft portion 91 is 8.97 mm that is larger than the size of the opening portion 81. As a result, the part of the shaft portion 91 where the shaft portion 91 has the maximum diameter, cannot be smoothly inserted into the opening portion 81. However, when the shaft portion 91 is pressed against the opening portion 81, the opening portion 81 is elastically widened. This allows the shaft portion 91 to be inserted (pressed) into the opening portion 81. Thereafter, the worker inserts the shaft portion 91 into the concave groove portion 80 such that the projection 85 is inserted into the cut 93. Since, as described above, the shaft portion 91 is formed in the double D-CUT shape, and the inner circumferential surface of the concave groove portion 80 is formed in the D-CUT shape, the shaft portion 91 of the sliding bearing portion 90 is attached to the concave groove portion 80 so as to be in close contact with the inner circumferential surface of the concave groove portion 80. This allows the shaft portion(s) 91 of the sliding bearing portion(s) 90 to be unrotatably attached to the concave groove portion(s) 80. In this way, since the cuts 93 and the projections 85 are provided in the roller support mechanism 70, the worker can easily attach the sliding bearing portions 90 to the concave groove portions 80 by inserting the shaft portions 91 into the concave groove portions 80 while aligning the cuts 93 with the projections 85.

In addition, the worker may attach the rotation shaft 61A to the roller support mechanism 70 as follows. That is, the worker inserts the shaft portions 91 into the opening portions 81 of the concave groove portions 80 in a state where the sliding bearing portions 90 have been attached to the rotation shaft 61A. As described above, the size S11 of the opening portion 81 is 8.09 mm, while the maximum outer diameter size S12 of the shaft portion 91 is 8.97 mm. As a result, the part of the shaft portion 91 where the shaft portion 91 has the maximum diameter, cannot be smoothly inserted into the opening portion 81. In this case, the worker rotates the two sliding bearing portions 90 to a position where the flat surfaces 91B can pass the opening portions 81, and then inserts the shaft portions 91 into the opening portions 81. At this time, the shaft portions 91 enter into the concave groove portions 80 such that the cuts 93 of the flanges 92 head toward the projections 85 of the side plates 73. Subsequently, the worker, while inserting the shaft portions 91 in the concave groove portions 80, rotates the sliding bearing portions 90 to a position where the projections 85 of the side plates 73 can be inserted in the cuts 93 of the flanges 92, namely, to a position where the cuts 93 are disposed at their uppermost position, and attaches the shaft portions 91 to the concave groove portions 80 so as to be in close contact with the inner circumferential surfaces of the concave groove portions 80.

The above-described embodiment provides an example case where the size S11 of the opening portions 81 is set to 8.09 mm, and the maximum outer diameter size S12 of the shaft portions 91 is set to 8.97 mm. However, the size S11 of the opening portions 81 is not limited to the above-described one. For example, the size S11 of the opening portions 81 may be in a range of 90% to 94% of the maximum outer diameter size S12, namely, in a range 8.073 mm≤S11≤0.83 mm. When the size S11 of the opening portions 81 is in this range, the sliding bearing portions 90 are in close contact with the inner circumferential surfaces of the concave groove portions 80, and are unrotatably attached to the concave groove portions 80 in a reliable manner.

In the above-described embodiment, the roller support mechanism 70 applied to the conveyance roller 61 is described as one example of the embodiment of the present disclosure. However, for example, the roller support mechanism 70 is applicable as a mechanism to support the rotation shaft of a roller member such as a conveyance roller included in the image forming portion 13, a driving roller of the pair of discharge rollers 25, and the heating roller 41 or the pressure roller 42 of the fixing portion 19.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A roller support mechanism comprising:

a pair of support plates formed from an elastic material and disposed to face each other;

two concave groove portions which are respectively formed in the pair of support plates and each of which includes an opening portion, two arc rims, and a straight line rim, the two arc rims extending in a groove depth direction of the concave groove portions from opposite ends of the opening portions, the straight line rim extending straightly and connecting extention ends of the two arc rims; and two sliding bearing portions respectively having bearing holes in which a rotation shaft of a roller member is inserted, wherein in a state where the rotation shaft is inserted in the bearing holes, the sliding bearing portions are inserted in the concave groove portions from the opening portions so that the sliding bearing portions are in close contact with inner circumferential surfaces of the concave groove portions and are unrotatably attached to the concave groove portions, wherein outer circumferential surfaces of the sliding bearing portions are formed in a shape that corresponds to the inner circumferential surfaces of the concave groove portions, each of the outer circumferential surfaces has a pair of arc surfaces and a pair of flat surfaces, the pair of arc surfaces being disposed to face each other and having a same curvature, the pair of flat surfaces being disposed to face each other, two projections are respectively formed on inner side surfaces of the pair of support plates, the sliding bearing portions respectively include flanges that come into surface contact with inner side surfaces of the support plates in a state where the sliding bearing portions are attached to the concave groove portions, the flanges projecting outward from the outer circumferential surfaces of the sliding bearing portions, and cuts are respectively formed in the flanges in which the projections are respectively inserted when the sliding bearing portions are attached to the concave groove portions.

2. The roller support mechanism according to claim 1, wherein a size of each of the opening portions is in a range of 90% to 94% of a maximum outer diameter size of each of the sliding bearing portions.

3. The roller support mechanism according to claim 1, wherein the two arc rims are separate from each other in an up-down direction in each of the concave groove portions, and each of the projections is formed above an upper arc rim among the two arc rims.

4. A sheet conveying device comprising:

the roller support mechanism according to claim 1; and a conveyance roller whose rotation shaft is rotatably supported by the roller support mechanism, the conveyance roller being configured to convey a sheet member.

5. An image forming apparatus comprising:

the sheet conveying device according to claim 4; and an image forming portion configured to form an image on the sheet member conveyed by the sheet conveying device.

6. The roller support mechanism according to claim 1, wherein each of the flanges has two cuts that are separate from each other by 180 degrees in an outer circumferential portion of each of the flanges.

7. The roller support mechanism according to claim 1, wherein a distance between the pair of arc surfaces that passes through a center of the rotation shaft is a maximum outer diameter of each of the sliding bearing portions, a distance between the pair of flat surfaces that passes through the center of the rotation shaft is a minimum outer diameter of each sliding bearing portion, and a size of each of the opening portions is smaller than the maximum outer diameter and larger than the minimum outer diameter.

* * * * *